US010016028B2

(12) United States Patent
Shirasaka

(10) Patent No.: US 10,016,028 B2
(45) Date of Patent: Jul. 10, 2018

(54) SUBSTANTIALLY ANNULAR-SHAPED ACCESSORY

(71) Applicant: KASHIKEY CO., LTD., Tokyo (JP)

(72) Inventor: Keiko Shirasaka, Tokyo (JP)

(73) Assignee: KASHIKEY CO., LTD., Tokyo (JP)

( * ) Notice: Subject to any disclaimer, the term of this patent is extended or adjusted under 35 U.S.C. 154(b) by 73 days.

(21) Appl. No.: 15/120,601

(22) PCT Filed: Aug. 27, 2014

(86) PCT No.: PCT/JP2014/004398

§ 371 (c)(1),
(2) Date: Nov. 30, 2016

(87) PCT Pub. No.: WO2016/030922

PCT Pub. Date: Mar. 3, 2016

(65) Prior Publication Data

US 2017/0071296 A1 Mar. 16, 2017

(51) Int. Cl.

| | |
|---|---|
| ***A44C 5/08*** | (2006.01) |
| ***A44C 7/00*** | (2006.01) |
| ***A44C 5/00*** | (2006.01) |
| ***A44C 5/02*** | (2006.01) |
| ***A44C 5/12*** | (2006.01) |

(52) U.S. Cl.

CPC ..... *A44C 5/0092* (2013.01); *A44C 5/022* (2013.01); *A44C 5/025* (2013.01); *A44C 5/08* (2013.01); *A44C 5/12* (2013.01); *A44C 7/00* (2013.01)

(58) Field of Classification Search

CPC ..... A44C 5/022; A44C 5/025; A44C 5/102; A44C 5/105; A44C 5/107; A44C 5/10; A44C 7/00; A44C 7/004; A44C 7/007; A44C 5/08; A44C 5/0092; A44C 5/12

USPC ..... 63/5.1, 5.2, 6, 9, 15.45, 15.7, 11, 12, 13, 63/14.1

See application file for complete search history.

(56) References Cited

U.S. PATENT DOCUMENTS

| | | | | | |
|---|---|---|---|---|---|
| 1,099,810 | A * | 6/1914 | Mehrlust | A44C 5/08 | 59/79.3 |
| 1,481,894 | A * | 1/1924 | Fishel | A44C 5/025 | 29/896.411 |
| 1,550,024 | A * | 8/1925 | Garst | A44C 5/08 | 59/79.2 |
| 1,739,722 | A * | 12/1929 | Kestenman | A44C 5/08 | 59/79.3 |

(Continued)

FOREIGN PATENT DOCUMENTS

| | | |
|---|---|---|
| CH | 681346 A5 | 3/1993 |
| JP | 36-7188 Y1 | 4/1961 |

(Continued)

*Primary Examiner* — Jack W Lavinder
(74) *Attorney, Agent, or Firm* — Im IP Law; C. Andrew Im

(57) ABSTRACT

A substantially annular-shaped accessory includes multiple arc-shaped structural elements that form a C-shaped annulus (major arc-shaped annulus) and a core. The core has a structure formed into a C-shaped annular-shaped accessory having an end gap of expandable/contractible width. One end of the core having a C-shaped member and an elastic body are fasten to a locking projection inside the arc-shaped structural element constituting one end section. Another end of the core is fasten to the locking projection inside the arc-shaped structural element constituting another end section.

5 Claims, 3 Drawing Sheets

(56) References Cited

U.S. PATENT DOCUMENTS

| | | | | | |
|---|---|---|---|---|---|
| 2,517,011 | A * | 8/1950 | Meyers | A44C 5/04 | 224/175 |
| 2,518,507 | A * | 8/1950 | Valcourt | A44C 5/08 | 59/79.3 |
| 2,667,739 | A * | 2/1954 | Flaig | A44C 5/08 | 59/79.2 |
| 3,580,438 | A | 5/1971 | Raval | | |
| 3,913,679 | A * | 10/1975 | Bucalo | A01L 1/04 | 168/24 |
| 5,471,787 | A * | 12/1995 | Weder | A47G 7/085 | 206/423 |
| 6,094,939 | A * | 8/2000 | Gavello | A44C 17/02 | 59/79.1 |
| 7,845,191 | B2 * | 12/2010 | Czajka | A44C 5/0084 | 63/15.5 |

FOREIGN PATENT DOCUMENTS

| | | |
|---|---|---|
| JP | 1987-90516 | 6/1987 |
| JP | H09-103310 A | 4/1997 |

* cited by examiner

SUBSTANTIALLY ANNULAR-SHAPED ACCESSORY

RELATED APPLICATION

This application is a § 371 application from PCT/JP2014/004398 filed Aug. 27, 2014, which is herein incorporated by reference in its entirety

TECHNICAL FIELD

The present invention relates to an accessory, such as a bangle, bracelet, necklace or earring, particularly to a substantially annular-shaped accessory formed into a C-shaped annulus by interconnecting multiple structural elements with cores made of C-shaped members and elastic bodies and having an end gap capable of width expansion/contraction.

BACKGROUND OF THE INVENTION

Some bangles used as accessories worn on the wrist, arm or ankle, for example, are formed as C-shaped annuluses provided at one portion with an end gap to make them smaller, lighter and easier to put on and take off than traditional ring-shaped bangles made of metal or the like. For still easier wearing, substantially annular-shaped accessories have been developed that interconnect multiple structural elements to form a substantially annular body having ends and enable diameter expansion by internally inserting a core made of a slender metal sheet, wire or similar.

Conventional expandable C-shaped annular accessories have the opposite ends of a C-shaped member, made of shape-memory alloy, for example, connected either by applying a conventional connecting method such as welding to one or another internal end of the substantially annular-shaped accessory or by engaging with a locking member. A diameter-expanding force applied when enlarging the diameter of the substantially annular accessory for putting it on an arm, for instance, fully acts on the opposite end engaging regions, so that a problem arises of the opposite end engaging regions easily breaking. Moreover, the small expandability range of the conventional structure raises a problem of the accessory being hard to put on.

Further, with a conventional substantially annular-shaped accessory made of simple cuboid structural elements, the end faces that are the mating surfaces between the structural elements come into contact during diameter enlargement, so that damage by contact during diameter enlargement with ornaments (e.g., diamonds) in the vicinity of the structural element surface ends becomes an issue. Moreover, in the case of a substantially annular-shaped accessory whose structural elements are simple cuboids, the surface ends come into full area contact during diameter enlargement, which is a problem because the resulting large resistance degrades ease of diameter enlargement and makes the accessory harder to put on and take off.

In the case of the conventional substantially annular-shaped accessory made of multiple structural elements of simple cuboid shape, a problem has been observed of the accessory's all-important appearance being spoiled by individual structural elements being laterally shifted under external pressure in the worn condition. Although substantially annular-shaped accessories incorporating a complicated internal structure for preventing lateral shifting have been developed, they are disadvantageous in the points of involving more production processes, higher die cost, and structural complexity.

As accessories are by nature worn for decoration, their design is of utmost importance and a major design factor particularly for accessories embellished with finely cut jewels is the angle of light incidence. In the case of the most common 58-facet brilliant-cut diamond that emerged from calculation of refraction index etc. for maximizing diamond brilliance, light incident from above reflects from every internal surface to shine out from the top, and this brilliance is considered to be the very essence of what the purchaser wants. With the aim of ensuring entry of light from various angles, cross-sectionally hemispheric bangles, rings and other products featuring diamonds or the like on the surface have been developed, but a need is still felt for ones that the user feels comfortable about putting on and taking off and that give a sense of firmness when worn.

The aforesaid accessory of hemispherical cross-sectional shape can elicit gorgeous brilliance from ornaments (such as diamonds) by enabling incidence of light from various angles, but the accessory has a problem of incurring breakage and gem detachment because its entire surface comes into contact with clothing, walls and various other objects. Moreover, the large, strong prongs required to hold a large ornament (such as a diamond) in order to prevent the ornament (such as a diamond) from falling out are apt to catch on clothing and similar, which is also a problem.

A desire has therefore been felt for a substantially annular-shaped accessory whose engaging region does not easily break, whose structural element surface ends do not interfere with ornaments (such as diamonds) during diameter enlargement, whose resistance to diameter enlargement is low, whose structural elements do not experience lateral shifting under pressure from the outside, and which enables ornaments to be set at various angles, can prevent ornaments (such as diamonds) from falling out, and does not require large, strong setting prongs.

PRIOR ART DOCUMENT

Patent Document

Patent Document 1:
Japanese Patent Publication (A) No. H9-103310

OBJECT AND SUMMARY OF THE INVENTION

Problems to be Overcome by the Invention

In order to overcome the aforesaid problems, the present invention has as its object to provide a substantially annular-shaped accessory comprising a C-shaped annulus wherein a decorative surface is formed groove-like in a longitudinal direction of the substantially annular-shaped accessory, mating end surfaces of arc-shaped structural elements are given wavy shapes, and at least one core comprising a C-shaped member and an elastic body is inserted inside interconnected arc-shaped structural elements, whereby adequate elasticity imparted to the core reduces damage to mating regions by diameter enlargement and enables diameter expansion/contraction by small force, large range of diameter expandability facilitates attachment/removal, contact of the decorative surface with surroundings is prevented, and ornaments (such as diamonds) of various sizes can be securely set at various positions and angles with small prongs.

Means for Solving the Problem

In order to achieve the aforesaid object, the substantially annular-shaped accessory according to the present invention is a substantially annular-shaped accessory 10 comprising arc-shaped structural elements 20 made of cuboids having mating end surfaces with openings, an arc-shaped structural element 22 constituting one endmost section, an arc-shaped structural element 24 constituting another endmost section, and cores 30 for forming a C-shaped annulus (major arc-shaped annulus) 11 having an end gap by interconnecting the multiple arc-shaped structural elements, wherein a decorative surface of the arc-shaped structural elements is formed groove-like in a longitudinal direction of the substantially annular-shaped accessory, core fitting holes are provided to penetrate through inner side walls on opposite longitudinal sides of the substantially annular-shaped accessory of arc-shaped structural elements, one of two mating end surfaces 26 interconnecting the arc-shaped structural elements is given a wavy shape perpendicular to the longitudinal direction, and another is given a wavy shape complementary to an adjacent connected one mating end surface.

Each core 30 comprises one or multiple C-shaped members 31 made of C-shaped shape-memory alloy fitted inside the multiple arc-shaped structural elements and an elastic body 32 for expanding width of the end gap, where one end 31*a* of the C-shaped member 31 is engaged with another end 32*b* of the elastic body 32, one end 32*a* of the elastic body 32 constituting one end of the core 30 is engaged with one locking projection 52 projecting from an inside end surface of an associated arc-shaped structural element, and another end 31*b* of the C-shaped member constituting another end of the core 30 is fastened to another locking projection 54 projecting from an internal end surface of an arc-shaped structural element, thereby configuring a C-shaped annulus having an end gap whose width is expandable/contractible.

The aforesaid substantially annular-shaped accessory is a bracelet configuration.

The aforesaid substantially annular-shaped accessory is an earring structure.

The substantially annular-shaped accessory 10 comprising the arc-shaped structural elements 20 made of cuboids having mating end surfaces with holes, the arc-shaped structural element 22 constituting one endmost section, the arc-shaped structural element 24 constituting another endmost section, and the cores 30 for forming the C-shaped annulus (major arc-shaped annulus) 11 having the end gap by interconnecting the multiple arc-shaped structural elements, which substantially annular-shaped accessory is an earring configuration equipped on an end side surface of one end with a post made of a cylindrical support column and on another opposing end side surface with a piercing catch.

Effects of the Invention

Being configured in the foregoing manner, the substantially annular-shaped accessory according to the present invention offers the following effects.

1. The cores, being formed of the C-shaped members made of shape-memory alloy and the elastic bodies, facilitate diameter expansion/contraction owing to presence of restoration force of the shape-memory alloy and elastic force of the elastic bodies and also enlarge movability range of diameter expansion capability, and the groove-like formation of the decorative surface prevents interference among ornaments (such as diamonds) during diameter enlargement, helps to prevent breakage/loss of ornaments (such as diamonds) by contact with surroundings, and further enables ornaments (such as diamonds) to be set at various angles with small prongs.

2. By forming the substantially annular-shaped accessory to about arm size, it can be used as a bracelet.

3. By forming the substantially annular-shaped accessory to a small size, it can be used as an earring.

4. By providing a post on one end side surface of the substantially annular-shaped accessory and installing a piercing catch on the other end side surface, the annular-shaped accessory can be used as a piercing earring.

BRIEF DESCRIPTION OF THE DRAWINGS

The substantially annular-shaped accessory according to the present invention is explained in detail below based on an embodiment shown in the drawings.

DETAILED DESCRIPTION OF THE EMBODIMENTS

Figure 1:
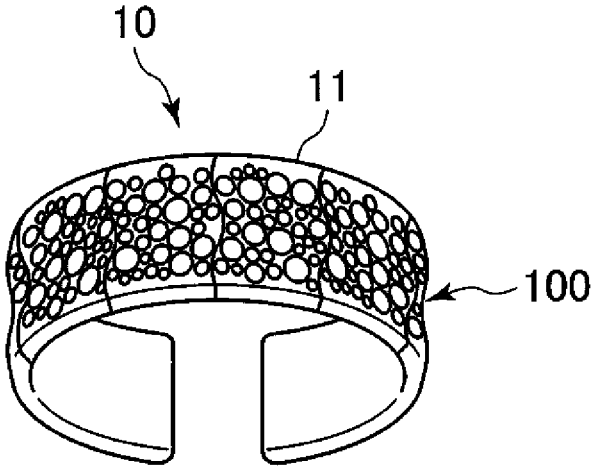
FIG. 1 is a perspective diagram of a substantially annular-shaped accessory according to the present invention.

The annular-shaped accessory 10 according to the present invention comprises the arc-shaped structural elements 20 (including the arc-shaped structural element 22 constituting the one end section and the arc-shaped structural element 24 constituting the other end section), and the cores 30 (formed of the C-shaped members 31 and the elastic bodies 32). The arc-shaped structural elements 20, the arc-shaped structural element 22 constituting the one end section, and the arc-shaped structural element 24 constituting the other end section are interconnected at their respective mating end surfaces 26 to form the C-shaped annulus 11, the cores 30 are fitted into core fitting holes 40 provided to penetrate through the inside of the C-shaped annulus 11, the one ends of the cores 30 are engaged with the one locking projections 52, and the other ends 31*b* of the cores are engaged with the other locking projections 54, thereby forming the substantially annular-shaped accessory.

Figure 4:
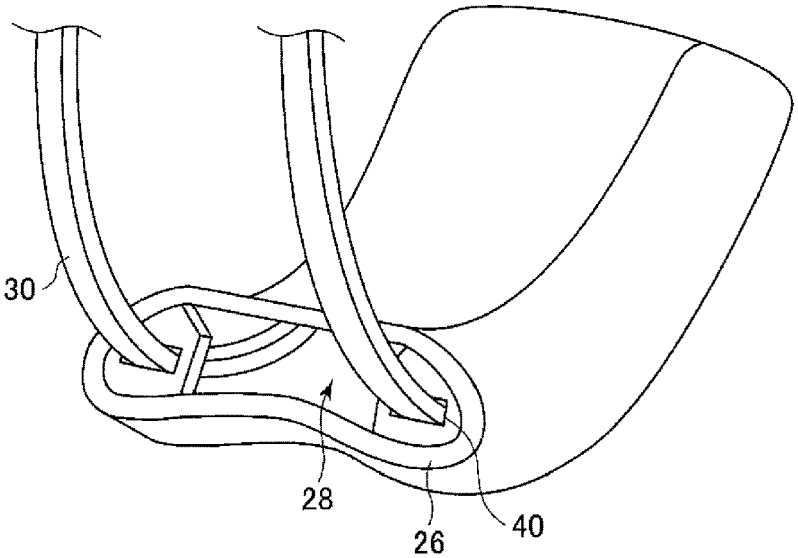
FIG. 4 is an enlarged exploded perspective view of the substantially annular-shaped accessory according to the present invention.
Figure 5:
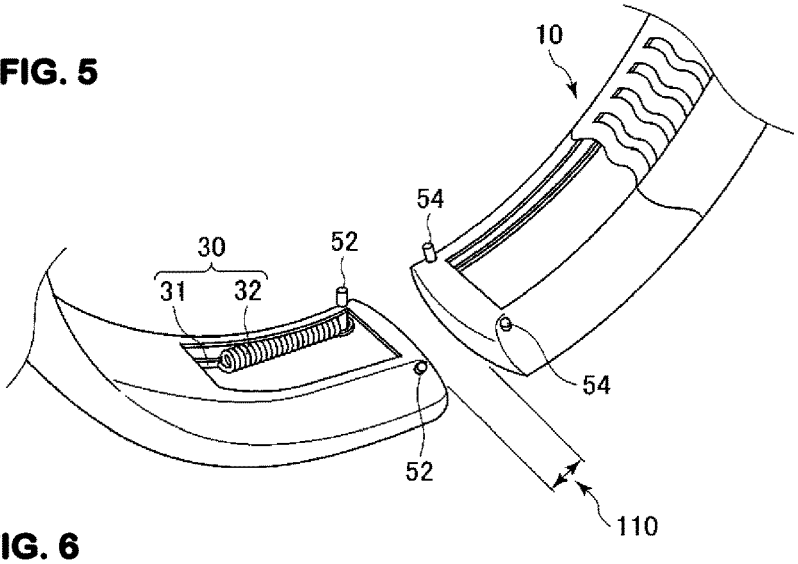
FIG. 5 is an enlarged exploded view of the end gap of the substantially annular-shaped accessory according to the present invention.
Figure 6:
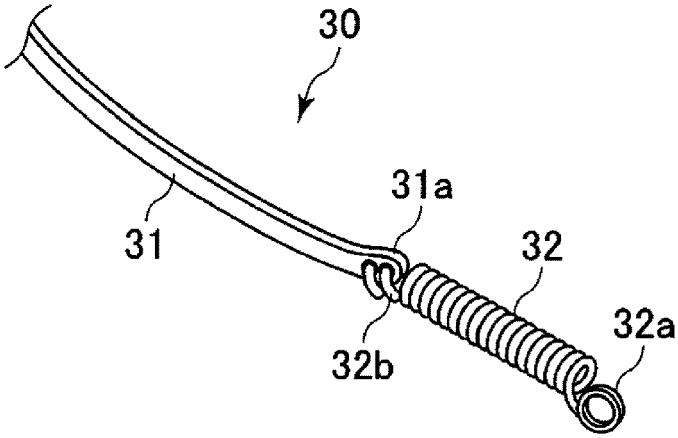
FIG. 6 is an enlarged perspective view of the end section of the core according to the present invention.

The annular-shaped accessory 10 is made using gold or other precious metal and comprises the arc-shaped structural elements 20, the arc-shaped structural element 22 constituting the one end section, the arc-shaped structural element 24 constituting the other end section, the C-shaped members 31, and the elastic bodies 32. The multiple arc-shaped structural elements 20, the arc-shaped structural element 22 constituting the one end section and the arc-shaped structural element 24 constituting the other end section are linked and are interconnected by the cores 30 made of the C-shaped members 31 and the elastic bodies 32, thereby configuring the substantially annular-shaped accessory to have the end gap. The decorative surface of the annular-shaped accessory 10 is formed groove-like in the longitudinal direction so that its cross-section is configured to have a gently rounded substantially concave shape as shown in FIG. 4. A configuration is adopted wherein the annular-shaped accessory 10 has multiple large and small ornaments (e.g., diamonds, gemstones, metal bits) set in its decorative surface at various angles matched to the curved surface of the groove.

Figure 2:
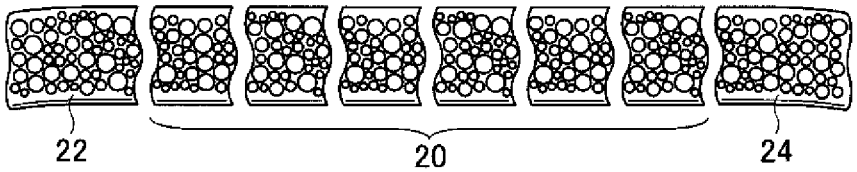
FIG. 2 is a perspective view of the arc-shaped structural elements of the substantially annular-shaped accessory according to the present invention in a state removed from the cores.
Figure 3:
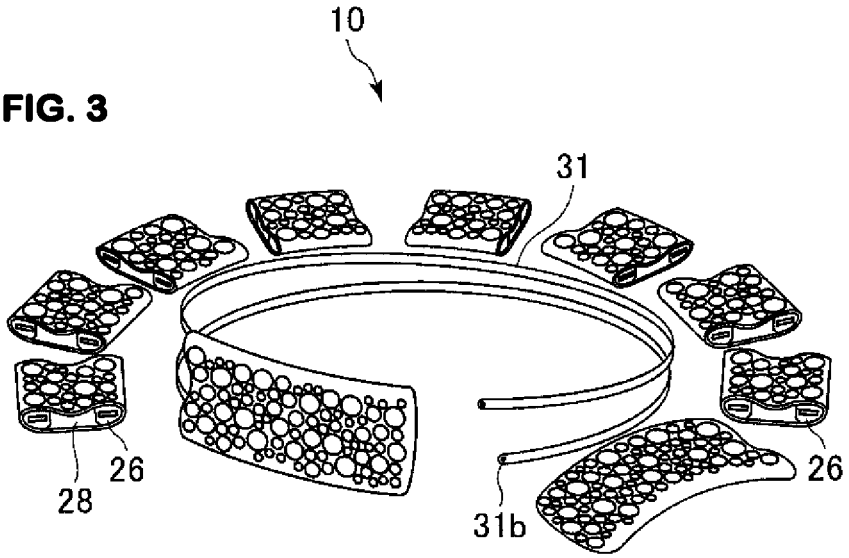
FIG. 3 is a perspective view in a state with only the arc-shaped structural element 22 constituting one end section of the substantially annular-shaped accessory according to the present invention fitted on the cores.

The arc-shaped structural elements 20 are constituted as curved box-like bodies comprising multiple cuboids formed with openings at opposite mating end surfaces, and configured to include the mating end surfaces 26, openings 28, and the core fitting holes 40. The multiple arc-shaped structural elements 20 are connected, the arc-shaped structural element 22 constituting the one end section is deployed at one end thereof, the arc-shaped structural element 24 constituting the other end section is deployed at the other end thereof, and the members are interconnected by the cores 30 comprising the C-shaped members 31 and the elastic bodies 32, thereby configuring an annular shape. In the present embodiment, six (FIG. 2) or eight (FIG. 3) arc-shaped structural elements 20 are used, but the number used in this embodiment is not a limitation and the size and number of the arc-shaped structural elements 20 can be arbitrarily decided with consideration to the size of the annular-shaped accessory 10.

The arc-shaped structural element 22 constituting the one end section has a configuration that is equipped with the mating end surface 26 and the one locking projections 52 and is formed with the mating end surface 26 at only one end of the arc-shaped structural element. The arc-shaped structural element 22 constituting the one end section does not have an opening on the end surface on the side where an end gap 110 is formed, and is provided with the one locking projections 52 at opposite corners of the inside end surface on the end gap 110 side. In the present embodiment, since the arc-shaped structural elements are formed using two cores 30, two of the one locking projections 52 are provided, but the number of locking projections is not limited to that in the present embodiment and, depending on decorative body diameter size or width (when slim), a substantially annular body can be formed using a single core 30.

The arc-shaped structural element 24 constituting the other end section has a configuration that includes the mating end surface 26 and the other locking projections 54, with the mating end surface 26 being formed at only one end of the arc-shaped structural element. The end side surface of the arc-shaped structural element 24 constituting the other end section does not mate with another member on the side where the end gap 110 is formed. Moreover, the other locking projections 54 that engage the cores 30 are provided at opposite corners of the inside end surface on the end gap 110 side. Although the configuration according to the present embodiment has the end gap 110, i.e., spaced ends, between the end surfaces of the arc-shaped structural element 22 constituting the one end section and the arc-shaped structural element 24 constituting the other end section, namely the end surfaces thereof that are not provided with the mating end surfaces 26, it is alternatively possible to adopt a configuration that establishes a C-shaped annular state in enlarged diameter condition and a state in which the opposite ends of the C-shaped annulus touch each other when worn on an arm or the like, namely, an openable/closable O-shaped configuration exhibiting an end gap when being put on (or being taken off).

A ring can be obtained by forming the substantially annular-shaped accessory according to the present invention in small diameter. As the cores 30 exhibit high elasticity, a single size is sufficient to deal with a range of finger ring sizes, and production of the substantially annular-shaped accessory in only one or a few size types enables provision of rings matched to the full range of ring sizes.

The mating end surfaces 26 are contact surfaces between the arc-shaped structural elements that are provided on both ends of the multiple arc-shaped structural elements 20 located in the middle and on the end surface on one side of the arc-shaped structural element 22 constituting the one end section and of the arc-shaped structural element 24 constituting the other end section, and are configured wavy in cross-section. The mating end surfaces 26 are configured to form the mating end surfaces of the arc-shaped structural elements 20 to be wave-shaped perpendicular to the longitudinal direction of the substantially annular-shaped accessory and to form the other in a wavy shape complementary to the adjacent one mating end surface. A configuration is adopted whereby the mating end surfaces of the multiple arc-shaped structural elements 20, the arc-shaped structural element 22 constituting the one end section and the arc-shaped structural element 24 constituting the other end section are snugly mated by the cores 30 comprising the C-shaped members 31 and the elastic bodies 32, thereby forming the annular-shaped accessory 10.

The openings 28 are open sectional regions provided in the mating end surfaces 26 of the arc-shaped structural elements 20 and are configured to be substantially rectangular in cross-section. The core fitting holes 40 are formed in these cross-sectional openings. In the present embodiment, for the purpose of, inter alia, reducing accessory weight and saving metal, the arc-shaped structural elements are constituted as hollow boxes whose cross-sections define the openings 28, but the openings 28 are not indispensable and it is alternatively possible to adopt a closed configuration.

Each core 30 is configured to comprise the C-shaped member 31 and the elastic body 32, with the one end 31*a* of the C-shaped member and the other end 32*b* of the elastic body joined. A configuration is adopted whereby the cores 30 comprising the C-shaped members 31 and the elastic bodies 32 are fitted by insertion into the core fitting holes 40 inside the substantially annular body obtained by interconnecting the arc-shaped structural element 22 constituting the one end section, the arc-shaped structural elements 20 and the arc-shaped structural element 24 constituting the other end section. The accessory of substantially annular shape is formed by engaging the one ends 32*a* of the elastic bodies 32 with the one locking projections 52 inside the arc-shaped structural element 22 constituting the one end section and engaging the other ends 31*b* of the C-shaped members 31 with the other locking projections 54 inside the arc-shaped structural element 24 constituting the other end section.

The C-shaped members 31 are made of slender metal sheets of shape-memory alloy and formed with small holes at both ends. A configuration is adopted whereby the one ends 31*a* of the C-shaped members are engaged with the other ends 32*b* of the elastic bodies 32 and the other ends 31*b* of the C-shaped members are engaged with the other locking projections 54 provided inside the arc-shaped structural element 24 constituting the other end section.

A configuration is adopted whereby the elastic bodies 32 are made of spring elements provided with engaging portions at both ends, the other ends are engaged with the one ends 31*a* of the C-shaped members, and the one ends 32*a* of the elastic bodies are engaged with the one locking projections 52 provided inside the arc-shaped structural element 22 constituting the one end section. Since the individual cores 30 are structured by combining the C-shaped member 31 made of shape-memory alloy exhibiting elasticity and the elastic body 32, it is possible to ensure a broad range of movability over which the end gap 110, i.e., spaced ends, can be pressed apart when putting on or taking off the substantially annular-shaped accessory. The use of abundant elasticity to secure the movability range enables large diameter expansion and makes it possible to put on and take off even a thick accessory with ease.

The core fitting holes 40 are through-holes formed in inner walls provided at both mating end surfaces of the arc-shaped structural elements 20, and the mating end surfaces 26 of the arc-shaped structural element 22 constituting the one end section and of the arc-shaped structural element 24 constituting the other end section. As two core fitting holes 40 are provided, one in each of the side walls on the left and right edges of the mating end surfaces 26, the configuration is such that the arc-shaped structural elements 20 having mating end surfaces 26 at both ends are provided with a total of four core fitting holes, and the arc-shaped structural element 22 constituting the one end section and the arc-shaped structural element 24 constituting the other end section, which have the mating end surfaces 26 at only one end, are each provided with two core fitting holes 40. The location, shape, number and so on of the core fitting holes 40 are not limited in the present invention insofar as the structural elements of the substantially annular-shaped accessory can be retained when the cores 30 are fitted and an adequate diameter expandability range can be secured.

The one locking projections 52 are cylindrical locking projections provided on opposite end gap 110 side corners inside the arc-shaped structural element 22 constituting the one end section, and a configuration is adopted whereby the elastic bodies 32 of the cores 30 are engaged with the one locking projections 52 by passing the one locking projections 52 through the locking members provided on the one ends 32*a* of the elastic bodies.

The other locking projections 54 are cylindrical locking projections provided on opposite end gap 110 side corners of the arc-shaped structural element 24 constituting the other end section, and a configuration is adopted wherein the C-shaped members 31 are engaged with the one locking projections 52 by passing the other locking projections 54 through the other ends 31*b* of the C-shaped members constituted as small holes formed in the C-shaped members 31.

Being constituted of the C-shaped members 31 made of shape-memory alloy and the elastic bodies 32, the cores 30 exhibit high elasticity by which a large movement range can be achieved that enables the end gap to be widely enlarged at the time of putting on or taking off the accessory. The large diameter expansion range attained makes even a thick annular accessory easy to put on and take off. Moreover, thanks to the adaptable tensioning force of the elastic bodies 32 (springs), diameter expansion with a small force is possible, while damage to the engaging regions can be simultaneously prevented because pressure acting on the locking projections and engaging regions is reduced in comparison to a conventional annular accessory comprising cores 30 made solely of slender metal sheets. In addition, the large diameter expansion possible results in larger clearance between the arc-shaped structural elements than heretofore, so that an effect of inhibiting accumulation of dirt and dust and preventing harm to appearance is exhibited.

In conventional annular accessories whose arc-shaped structural elements are simple cuboids, the contacting surface ends between structural elements come into full area contact with adjacent surface ends during diameter enlargement, so that ornaments (e.g., diamonds) in the vicinity of the structural element surface ends interfere during diameter expansion, which becomes a cause of ornament breakage/loss. In the present invention, the cores 30 comprising the C-shaped members 31 and elastic bodies 32 ensure a large range of movability, the decorative surface of the annular-shaped accessory 10 is formed groove-like in the longitudinal direction, and the mating end surfaces 26 are given a wavy shape, whereby a configuration is obtained by which only a portion of the connection surfaces of the decorative surface make contact during diameter expansion, so that the portions not making contact during diameter expansion can be freely designed without sacrificing decoration of the connecting end portion regions. Further, since the surface ends of the connection portions do not come into full area contact during diameter expansion, diameter expansion resistance is small and the diameter can be easily enlarged.

Figure 7:
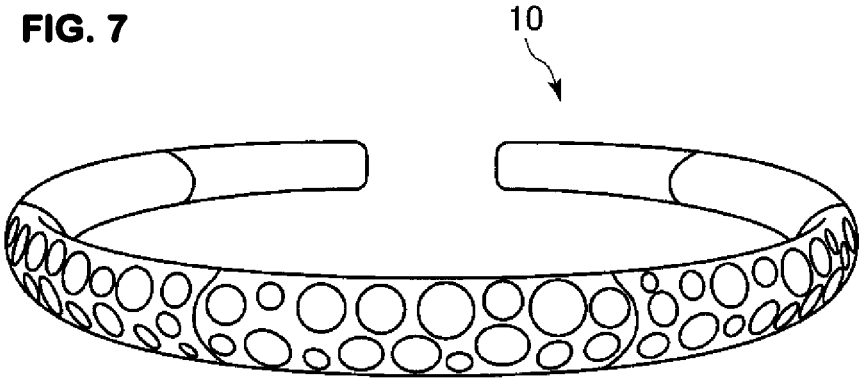
FIG. 7 is a perspective view of another embodiment of the substantially annular-shaped accessory according to the present invention.

Instead of forming the decorative surface to have a groove-like shape in the longitudinal direction, it is possible to form the surface to have a protruded shape, as shown in FIG. 7, and also possible to form the surface flat.

Occurrence of lateral shifting and twisting among the individual arc-shaped structural elements due to forces acting perpendicular to the longitudinal direction can be prevented because substantial annularity is maintained by the expansion/contraction forces produced by the cores 30 having the C-shaped members 31 and the elastic bodies 32. Owing to this structure, the substantially annular-shaped accessory does not shift laterally or deform, so that the configuration ensures no impairment of the accessory's most important asset, namely, its appearance. Another effect is that the prevention of lateral shifting deters damage to the substantially annular-shaped accessory. So since lateral shifting is not prevented by a complicated internal structure but by a configuration that uses wavy connection surfaces, lateral shifting can be prevented by a simple structure.

In an accessory decorated with polished diamonds or other gemstones, light reflection enhanced by cutting and polishing is an essential factor, and this makes ornament setting angle very important when a number of ornaments are arranged. As the decorative surface of the substantially annular-shaped accessory according to the present invention is formed gently groove-like in the longitudinal direction of the annular-shaped accessory 10, the surface is curved along the longitudinal direction of the surface, thereby enabling ornaments to be set at various angles. As a result, light from a greater variety of angles can be caught and reflected than when ornaments are arranged solely at one fixed angle.

Moreover, since the groove-like formation of the decorative surface keeps ornaments in the groove-like region from coming into contact with surroundings, breakage/loss of ornaments (such as diamonds) and the like can be prevented. As diamonds and other ornaments set in the recessed region do not make direct contact with the exterior, the ornaments can be retained without using large prongs, so that the configuration enables large-sized ornaments to be set with small prongs that do not impair appearance.

As set out in the foregoing, the substantially annular-shaped accessory according the present invention is easy to put on and take off thanks to the large diameter expansion movement range it achieves by dint of the cores 30 equipped with the C-shaped members 31 and the elastic bodies 32. Further, dispersion of pressure by the cores 30 prevents damage to portions connected with the locking projections 52 and 54 at opposite ends, whereby long-term use becomes possible. In addition, decorativeness can be enhanced by ornaments (e.g., diamonds) set at various angles, and damage and fall-out of ornaments can be prevented.

EXPLANATION OF SYMBOLS

10 Annular-shaped accessory
11 C-shaped annulus
20 Arc-shaped structural element
22 Arc-shaped structural element constituting one end section
24 Arc-shaped structural element constituting other end section
26 Mating end surface
28 Opening
30 Core
31 C-shaped member
31*a* One end of C-shaped member
31*b* Other end of C-shaped member
32 Elastic body
32*a* One end of elastic body
32*b* Other end of elastic body
40 Core fitting hole
52 One locking projection
54 Other locking projection
100 Decorative surface
110 End gap

The invention claimed is:

1. A substantially annular-shaped accessory comprising:

a plurality of arc-shaped structural elements made of cuboids comprising mating end surfaces with openings, two of the arch-shaped structural elements respectively constituting a first endmost section and a second endmost section;

cores to form a C-shaped annulus comprising an end gap by interconnecting the plurality of arc-shaped structural elements to provide the substantially annular-shaped accessory;

the arc-shaped structural elements comprising a groove-like decorative surface in a longitudinal direction of the substantially annular-shaped accessory, core fitting holes to penetrate through inner side walls on opposite longitudinal sides of the substantially annular-shaped accessory of arc-shaped structural elements, one of the two mating end surfaces interconnecting the arc-shaped structural elements has a wavy shape perpendicular to the longitudinal direction, and other mating end surface has a wavy shape complementary to a mating end surface of an adjacent arch-shaped structural element; and each core comprises one or multiple C-shaped members made of C-shaped shape-memory alloy fitted inside the plurality of the arc-shaped structural elements and an elastic body to expand a width of the end gap, wherein a first end of a C-shaped member is engaged with a first end of the elastic body, a second end of the elastic body constituting a first end of the core is engaged with one locking projection projecting from an inside end surface of an associated arc-shaped structural element, and a second end of the C-shaped member constituting a second end of the core is fastened to another locking projection projecting from an internal end surface of an arc-shaped structural element, thereby configuring the width of the end gap of the C-shaped annulus to be expandable or contractible.

2. The substantially annular-shaped accessory of claim 1, wherein the cores form a major arc-shaped annuls.

3. The substantially annular-shaped accessory of claim 1 is a bracelet.

4. The substantially annular-shaped accessory of claim 1 is an earring.

5. A substantially annular-shaped accessory comprising:

a plurality of arc-shaped structural elements made of cuboids comprising mating end surfaces with holes, two of the arch-shaped structural elements respectively constituting a first endmost section and a second endmost section;

at least one core to form a C-shaped annulus comprising an end gap by interconnecting the plurality of arc-shaped structural elements to provide the substantially annular-shaped accessory;

the arc-shaped structural elements comprising a groove-like decorative surface in a longitudinal direction of the substantially annular-shaped accessory, core fitting holes to penetrate through inner side walls on opposite longitudinal sides of the substantially annular-shaped accessory of arc-shaped structural elements, one of the two mating end surfaces interconnecting the arc-shaped structural elements has a wavy shape perpendicular to the longitudinal direction, and other mating end surface has a wavy shape complementary to a mating end surface of an adjacent arch-shaped structural element;

each core comprises one or multiple C-shaped members made of C-shaped shape-memory alloy fitted inside the plurality of the arc-shaped structural elements and an elastic body to expand a width of the end gap, wherein a first end of a C-shaped member is engaged with a first end of the elastic body, a second end of the elastic body constituting a first end of the core is engaged with one locking projection projecting from an inside end surface of an associated arc-shaped structural element, and a second end of the C-shaped member constituting a second end of the core is fastened to another locking projection projecting from an internal end surface of an arc-shaped structural element, thereby configuring the width of the end gap of the C-shaped annulus to be expandable or contractible; and wherein the substantially annular-shaped accessory is a piercing earring equipped on an end side surface of one end with a post made of a cylindrical support column and on another opposing end side surface with a piercing catch.

* * * * *